US007490820B2

(12) United States Patent
Kobayashi

(10) Patent No.: US 7,490,820 B2
(45) Date of Patent: Feb. 17, 2009

(54) SHEET BENDING APPARATUS AND STAPLING APPARATUS

(75) Inventor: Tsutomu Kobayashi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 311 days.

(21) Appl. No.: 11/219,675

(22) Filed: Sep. 7, 2005

(65) Prior Publication Data

US 2006/0049570 A1 Mar. 9, 2006

(30) Foreign Application Priority Data

Sep. 7, 2004 (JP) ..... 2004-259918

(51) Int. Cl.
*B65H 37/04* (2006.01)

(52) U.S. Cl. ..... 270/37; 270/58.04; 270/58.08; 270/58.09

(58) Field of Classification Search ..... 270/37, 270/58.04, 58.08, 58.09
See application file for complete search history.

(56) References Cited

U.S. PATENT DOCUMENTS 5,876,027 A * 3/1999 Fukui et al. ..... 270/51
6,022,011 A * 2/2000 Hirose ..... 270/37
6,773,005 B2 * 8/2004 Sato et al. ..... 270/58.11
6,910,686 B2 * 6/2005 Awano ..... 270/37
6,957,810 B2 * 10/2005 Yamada et al. ..... 270/58.08
6,976,672 B2 * 12/2005 Kawata ..... 271/9.11
6,981,697 B2 * 1/2006 Sasa et al. ..... 270/58.11
2006/0279037 A1 * 12/2006 Kushida et al. ..... 270/58.08

FOREIGN PATENT DOCUMENTS

JP 11-322172 11/1999

* cited by examiner

*Primary Examiner*—Gene Crawford
*Assistant Examiner*—Leslie A Nicholson, III
(74) *Attorney, Agent, or Firm*—Morgan, Lewis & Bockius LLP

(57) ABSTRACT

A sheet bending apparatus bends a sheet in a standing state. The apparatus includes: an information obtaining section that obtains a sheet information indicating the type of the sheet; a sheet moving member that has an abutting section capable of abutting the bottom edge of the sheet and vertically moves the sheet with the abutting section; a sheet bending section that is disposed within a range of the movement of the sheet moved by the sheet moving member, has a pushing member extending laterally and intersecting the vertical direction of the sheet, and bends the sheet by causing the pushing member to push a predetermined position of the sheet; and a controlling section that controls an amount of movement of the abutting section according to the type of the sheet to allow the abutting section to abut the predetermined position of the sheet.

4 Claims, 5 Drawing Sheets

SHEET BENDING APPARATUS AND STAPLING APPARATUS

BACKGROUND OF THE INVENTION

1. Field of the Invention

The present invention relates to a sheet bending apparatus which bends a sheet in a standing state, and to a stapling apparatus which staples stacked sheets that are changed from a horizontally lying state to a standing state.

2. Description of the Related Art

Generally, as an example of paperwork carried out with a relatively high frequency, there is a work to produce a booklet. In such a work, a set of sheets is formed by stapling sheets having thereon images formed by an image forming device such as printers and copying machines, and the set of sheets is bent in two, thereby a booklet is produced. As an apparatus for easily carrying out such a work, there is proposed an apparatus which forms a set of sheets by stapling sheets and bending the stapled set in two (see Japanese Patent Application Publication No. 11-322172 for example).

The apparatus shown in Japanese Patent Application Publication No. 11-322172 is provided with a storage system for storing sheets in a standing state that are sequentially transferred along predetermined transfer paths arranged in the apparatus. This storage system vertically moves the sheets stored in a standing state and is provided with a stapler for performing stapling processing and a bending system for performing bending processing within a range of the movement of the sheets. The stapler has a staple feeding opening for feeding a staple while holding the sheets stacked in a standing state and staples the sheets while holding a predetermined position of the sheets such as the center thereof in the feeding opening. In addition, the bending system includes a pushing member laterally extending and intersecting the vertical direction of the standing sheets and causes the pushing member to push a predetermined position of the sheets such as the center thereof to bend the sheets into two. The storage system moves the sheets stored in a standing state for a predetermined distance until the predetermined position of the sheets reaches a position in the staple feeding opening and in front of the pushing member of the bending system.

Incidentally, an apparatus of this type uses various kinds of sheets different in flexural rigidity due to difference in thickness. For example, there is used a relatively thin and less rigid sheet such as coated paper whose image-formed surface has been subjected to a surface treatment. This type of sheets may be stored in the storage system while remaining flexed by the self weight. As a result, the predetermined position of the sheets may not be aligned with the staple feeding position and the pushing member of the bending system, resulting in a defect such as stapling and bending at a position other than the predetermined position.

SUMMARY OF THE INVENTION

The present invention has been made in view of the above circumstances and provides a sheet bending apparatus capable of bending various kinds of sheets and a stapling apparatus capable of stapling a predetermined position of the various kinds of sheets.

According to one embodiment of this invention, a sheet bending apparatus bends a sheet in a standing state, the apparatus including: an information obtaining section that obtains sheet information indicating the type of the sheet; a sheet moving member that includes an abutting section capable of abutting the bottom edge of the sheet in a standing state and of freely moving vertically and vertically moves the sheet by causing the abutting section to move vertically; a sheet bending section that is disposed within a range of movement of the sheet moved by the sheet moving member, has a pushing member extending laterally and intersecting the vertical direction of the sheet, and bends the sheet by causing the pushing member to push a predetermined position of the sheet moved by the sheet moving member, the predetermined position of the sheet being in the vertical direction of the sheet; and controlling section that controls an amount of movement of the abutting section according to the type of the sheet indicated by the sheet information obtained in the information obtaining section so as to allow the abutting section to abut the predetermined position of the sheet.

According to another embodiment of this invention, a stapling apparatus staples stacked sheets in a standing state, the apparatus including: an information obtaining section that obtains sheet information indicating the type of the sheets; a sheet moving member that includes an abutting section capable of abutting the bottom edges of the sheets stacked in a standing state and of freely moving vertically and vertically moves the stacked sheets by causing the abutting section to move vertically; a stapler that is disposed within a range of movement of the stacked sheets moved by the sheet moving member and has a staple feeding opening for feeding a staple by holding the stacked sheets and staples the stacked sheets by causing the staple feeding opening to hold a predetermined position of the sheets moved by the sheet moving member, the predetermined position of the sheets being in the vertical direction of the sheets; and a controlling section that controls an amount of movement of the abutting section according to the type of the sheets indicated by the sheet information obtained in the sheet information obtaining section so as to allow the staple feeding opening to hold the predetermined position of the stacked sheets.

BRIEF DESCRIPTION OF THE DRAWINGS

An embodiment of the present invention will be described below in detail based on the following figures, wherein.

DETAILED DESCRIPTION OF THE INVENTION

An embodiment of the present invention will be described below with reference to the drawings.

Figure 1:
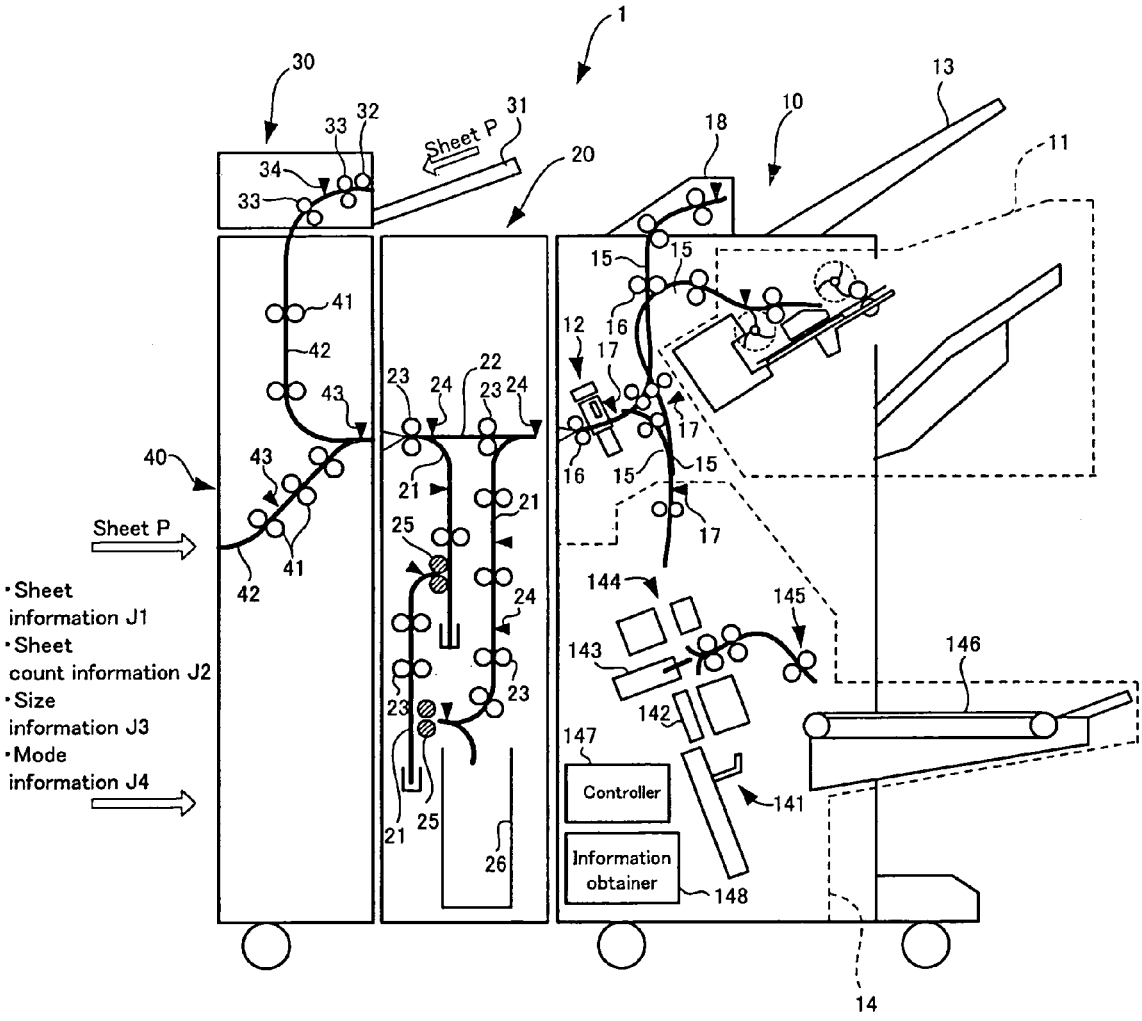
FIG. 1 illustrates an example of a post-processing device provided with an embodiment of the present invention.

FIG. 1 illustrates an example of a post-processing device provided with an embodiment of the present invention.

The post-processing device 1 shown in FIG. 1 is a device that receives sheets P having an image formed thereon and sent from an image forming device (not shown). The post-processing device 1 bends and staples the sheets P. The post-processing device 1 includes a final processing unit 10, a folder unit 20, an interposer 30, and an interface module 40.

The final processing unit 10 includes a sheet output unit 11, a puncher 12, a top tray 13, and a booklet unit 14. The booklet unit 14 corresponds to an embodiment of each of the "sheet bending apparatus" and the "stapling apparatus" according to the present invention.

In the example shown in FIG. 1, a sheet P having an image formed thereon and plural pieces of information such as sheet information J1, sheet count information J2, size information J3, and mode information J4, which will be described later, are fed from an image forming device (not shown) to the interface module 40. The sheet information J1 corresponds to an example of the "sheet information" according to the present invention.

The interposer 30 is provided with a paper tray 31 on which a user places sheets P. The sheets P placed on the paper tray 31 are each taken in by a pickup roller 32 and transferred to the interface module 40 by transfer rollers 33. The movement of the sheets P in the interposer 30 is monitored by a sheet sensor 34 disposed in the interposer 30.

In the interface module 40, sheet transfer paths 42 are formed by transfer rollers 41 and guide members (not shown) disposed between the transfer rollers 41. Sheets P fed from the image forming device and the interposer 30 are transferred along the sheet transfer paths 42 to the folder unit 20 disposed subsequent to the interface module 40. The passage of the sheets P on the transfer paths 42 is monitored by sensors 43 disposed at the sheet transfer paths 42. In addition, the pieces of information J1 through J3 sent from the image forming device are sent to the booklet unit 14 of the final processing unit 10.

In the folder unit 20, folded-sheet transfer paths 21 and a normal transfer path 22 are formed by transfer rollers 23 and guide members (not shown). The folded-sheet transfer path 21 is to transfer sheets P to be subjected to folding processing such as Z-folding which is designated by a user, whereas the normal transfer path 22 is to transfer sheets P directly to the final processing unit 10 disposed subsequent to the folder unit 20. The passage of the sheets P is monitored by sensors 24 disposed at the transfer paths 21 and 22. Folding rollers 25 are disposed at the folded-sheet transfer paths 21. When a user designates Z-folding processing, a sheet P is nipped by the rollers 25 while being transferred along the folded-sheet transfer paths 21 so as to be folded. The folder unit 20 has a storage 26 for accommodating the folded sheets P.

As mentioned above, the final processing unit 10 includes the sheet output unit 11, the puncher 12, the top tray 13, and the booklet unit 14. These components are connected by sheet transfer paths 15 which are formed by transfer rollers 16 and guide members (not shown). In addition, sheet sensors 17 are disposed at the sheet transfer paths 15 to monitor the passage of sheets P.

Every sheet P fed to the final processing unit 10 first goes through the puncher 12. When punching processing is designated by a user, the punching processing is applied to the sheet P at this puncher 12. When stapling processing is designated by the user, the sheet P that has passed the puncher 12 is transferred to the sheet output unit 11. When booklet producing processing including stapling and bending sheets P into two is designated by the user, the sheet P is transferred to the booklet unit 14. When no particular processing is designated by the user, the sheet P is transferred to a top tray outlet 18 to be output to the top tray 13.

The feature of the present invention in the post-processing device 1 shown in FIG. 1 lies in the booklet unit 14. Thus, the booklet unit 14 will be mainly described hereinafter.

When designated by the user, the booklet unit 14 carries out booklet producing processing including forming a set of sheets by stapling the center of stacked sheets P and bending the set of sheets into two at the center, which are sequentially performed. The center of the stacked sheets P is an example of the "predetermined position in a vertical direction" according to the present invention. The booklet unit 14 includes a sheet storage system 141, a stapler 142, a bending system 143, a tamper 144, output rollers 145, a booklet tray 146, a controller 147, and an information obtainer 148. The stapler 142, the bending system 143, the controller 147, and the information obtainer 148 correspond to examples of the "stapler," "sheet bending section," "controlling section," and "information obtaining section" according to the present invention, respectively. While the controller 147 and the information obtainer 148 will be described later, other elements composing the booklet unit 14 will be described first.

Figure 2:
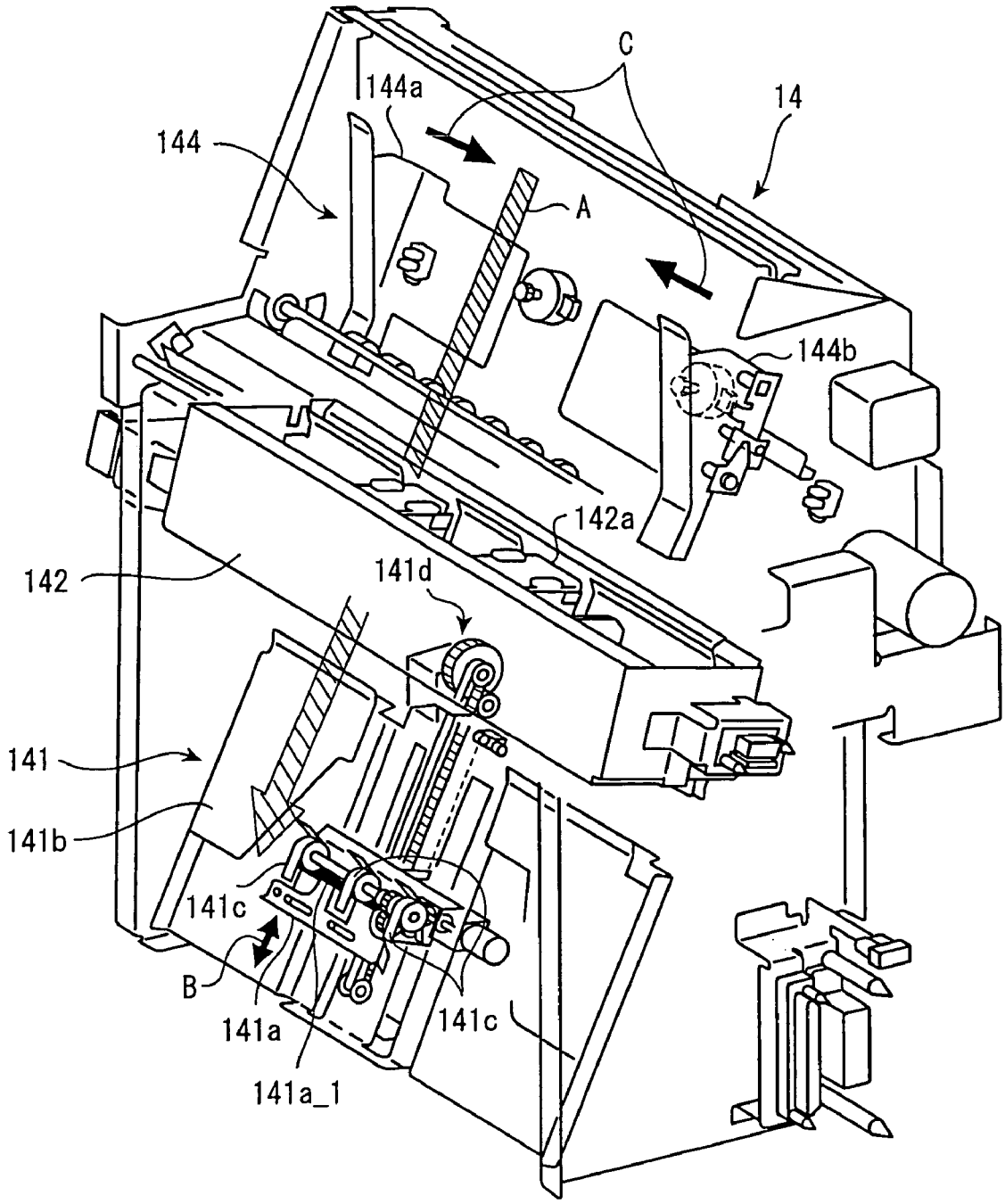
FIG. 2 is a perspective view of a booklet unit viewed from a booklet tray side.
Figure 3:
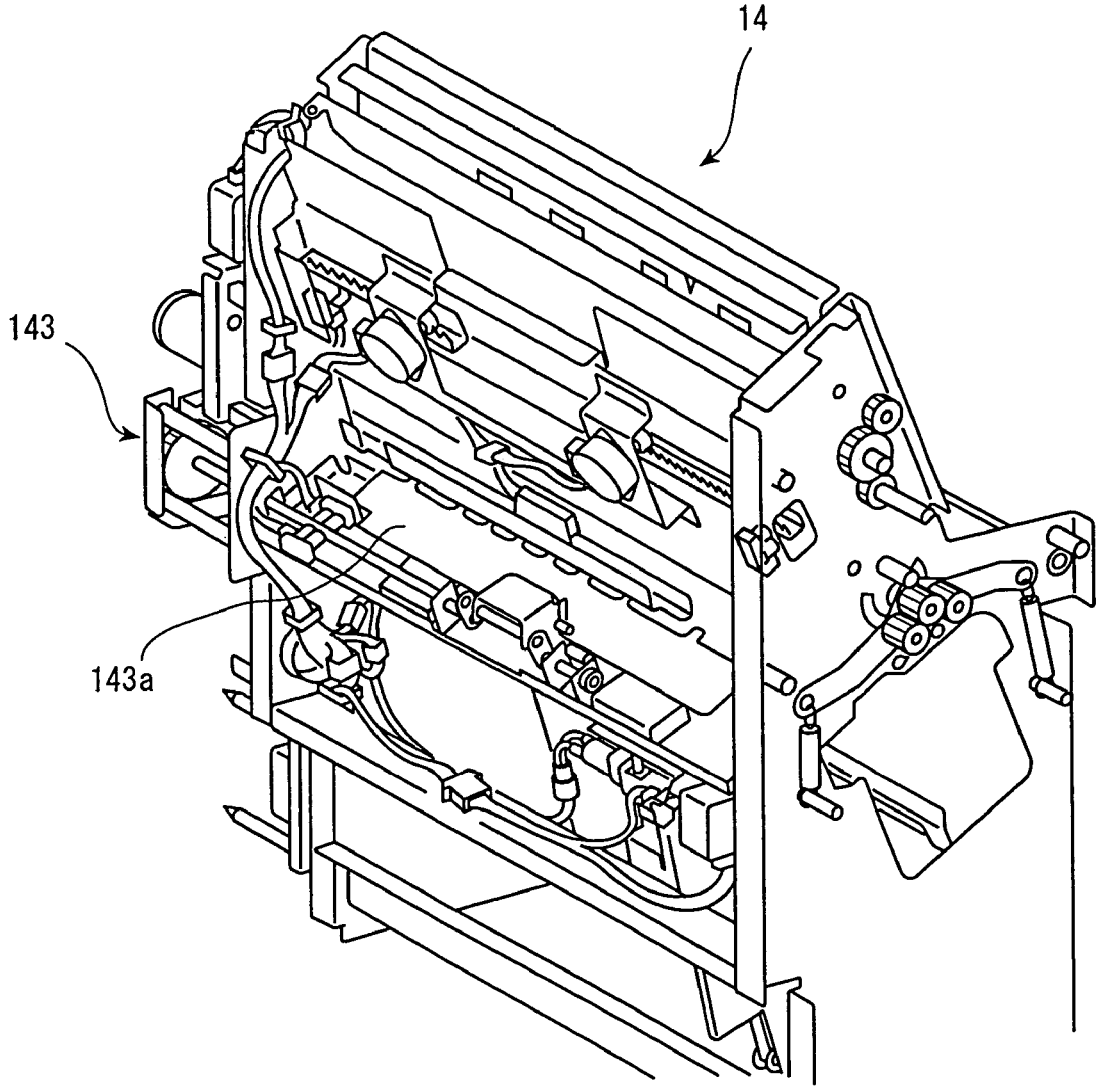
FIG. 3 is a perspective view of the booklet unit viewed from the back thereof shown in FIG. 2.

FIGS. 2 and 3 are diagrams showing a partial internal structure of the booklet unit 14. For convenience, FIGS. 2 and 3 illustrate the booklet unit 14 except for the booklet tray 146 shown in FIG. 1. FIG. 2 is a perspective view of the booklet unit 14 viewed from the booklet tray 146 side, whereas FIG. 3 is a perspective view of the booklet unit 14 viewed from the back thereof shown in FIG. 2.

The sheet storage system 141, the stapler 142, and the tamper 144 are shown in FIG. 2. The sheet storage system 141 includes an end guide 141*a*, a compile tray 141*b*, three paddles 141*c*, and an end guide moving system 141*d*. The combination of the end guide 141*a* and the end guide moving system 141*d* corresponds to an example of the "sheet moving member" according to the present invention. The end guide 141*a* corresponds to an example of the "abutting section" according to the present invention.

Sheets P that have been sequentially transferred to the booklet unit 14 fall in a direction shown by an arrow A in the booklet unit 14. The bottom edge of each sheet P is guided by the rotation of the paddles 141*c* and received by a sheet receiving surface 141*a*_1 disposed at a predetermined sheet receiving position that will be described later. As a result, two or more sheets are stacked in a standing posture. At this point, the position of the sheets P in a width direction is regulated by the compile tray 141*b* disposed to surround the lower part of the sheets P.

The end guide 141*a* is moved by the end guide moving system 141*d* composed of a motor and a transfer belt in a vertical direction shown by an arrow B. The end guide 141*a* which has received the sheets P is moved by the end guide moving system 141*d* so that the sheets P are transferred to positions which will be described later in the booklet unit 14.

At the stapler 142, the center of the sheets P, which are transferred by the end guide 141*a* moved by the end guide moving system 141*d* and stacked in a standing state, is now held in a staple feeding opening 142*a* and stapled to bind the sheets P, thereby a set of sheets is formed. Immediately before the sheets P are bound, two wall members 144*a* and 144*b* of the tamper 144 are moved in a direction shown by an arrow C to align the edges in a vertical direction of the sheets P stacked in a standing state.

FIG. 3 shows the bending system 143 provided with a blade 143*a*.

The blade 143*a* extends in a width direction of sheets P or a set of sheets stored in a standing state in the sheet storage system 141. The blade 143*a* pushes and bends sheets P or a set of sheets P.

Next, there will be described a sequence of movements in the booklet unit 14, which includes receiving sheets P sequentially transferred to the booklet unit 14, forming a set of sheets by stapling the sheets P, producing a booklet by bending the set of sheets into two, and outputting the booklet.

Figure 4:
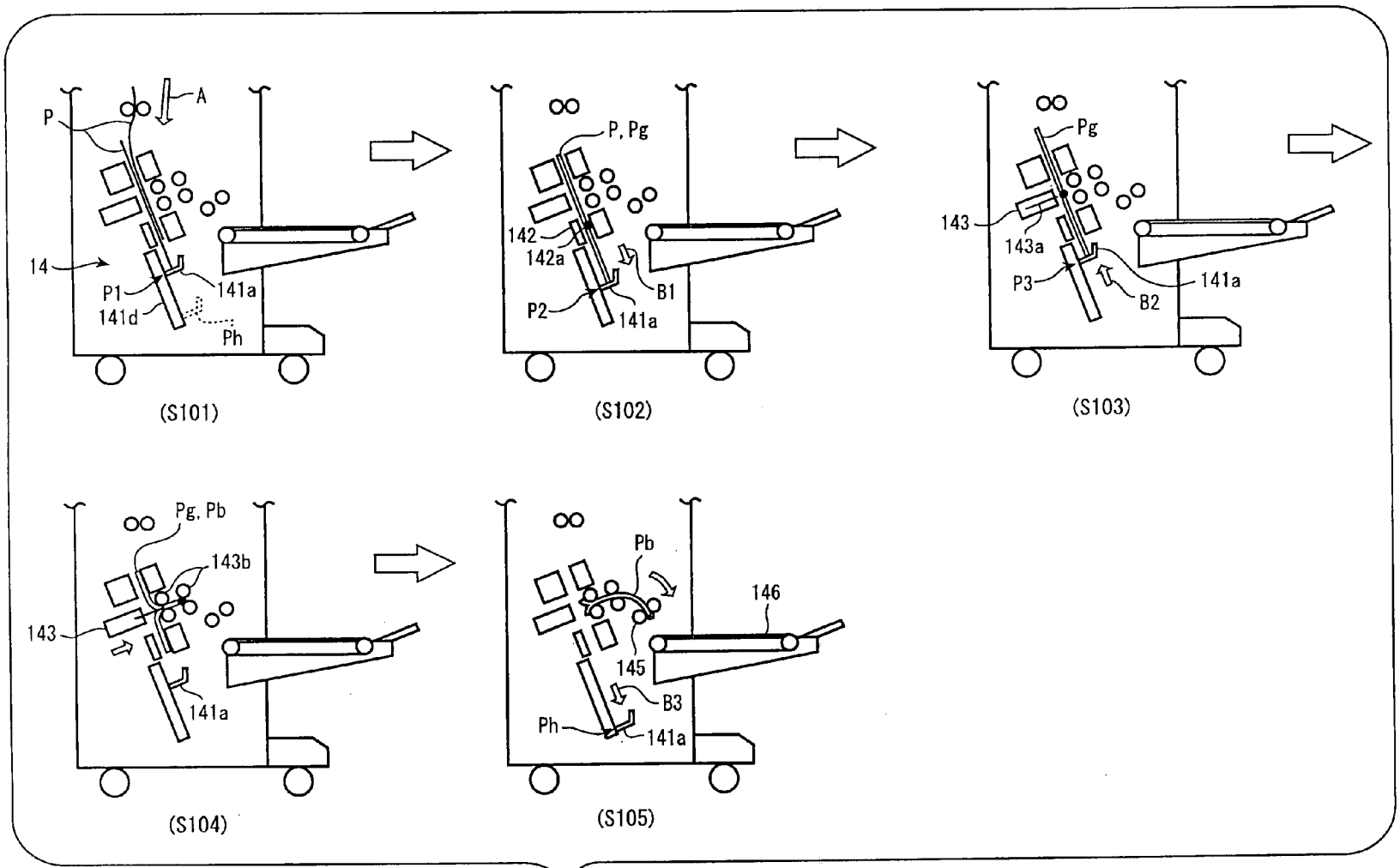
FIG. 4 shows a sequence of movements in the booklet unit.

FIG. 4 shows a sequence of movements in the booklet unit 14 shown in FIG. 1.

As shown in step S101, sheets P sequentially transferred to the booklet unit 14 fall in a direction shown by the arrow A that is also shown in FIG. 2 in the booklet unit 14. At this point, the end guide 141*a* has been moved by the end guide moving system 141*d* from a home position Ph to a sheet receiving position P1 according to the size of the sheets P which will be described later. Therefore, the bottom edges of the sheets Pare received by the end guide 141*a*, thereby the sheets P are stacked in a standing state.

Upon completion of the movement in step S101 and the sheets P to compose a single booklet are all stacked, the end guide 141*a* having the sheets P stacked thereon is moved to a staple position P2 in a direction shown by an arrow B1 so that the center of the sheets P is held in the staple feeding opening 142*a* of the stapler 142. Subsequently, the stapler 142 staples the center of the sheets P stacked on the end guide 141*a* to form a set Pg of sheets (step S102).

Subsequently, the end guide 141*a* having the sheets P stacked thereon is moved to a bending position P3 in a direction shown by an arrow B2 so that the center of the set Pg of sheets is positioned in front of the blade 143*a* of the bending system 143 (step S103).

Then, the blade 143*a* pushes the center of the set Pg of sheets on the end guide 141*a* positioned at the bending position P3, thereby the set Pg of sheets is bent. Subsequently, the set Pg of sheets is fed to nips formed between two pairs 143*b* of rollers facing each other sequentially (step S104), where the set Pg of sheets is bent into two thereby a booklet Pb is produced.

The booklet Pb thus produced is output on the booklet tray 146 by the output rollers 145 (step S105). At this step, the end guide 141*a* is moved to the home position Ph in a direction shown by an arrow B3.

The above-described movements of the elements composing the booklet unit 14 are controlled by the controller 147 in accordance with a flowchart described below. The information obtainer 148 obtains information such as sheet information J1, sheet count information J2, size information J3, and mode information J4 input from an image forming device (not shown) to the interface module 40 in order to use the obtained information for controlling.

Figure 5:
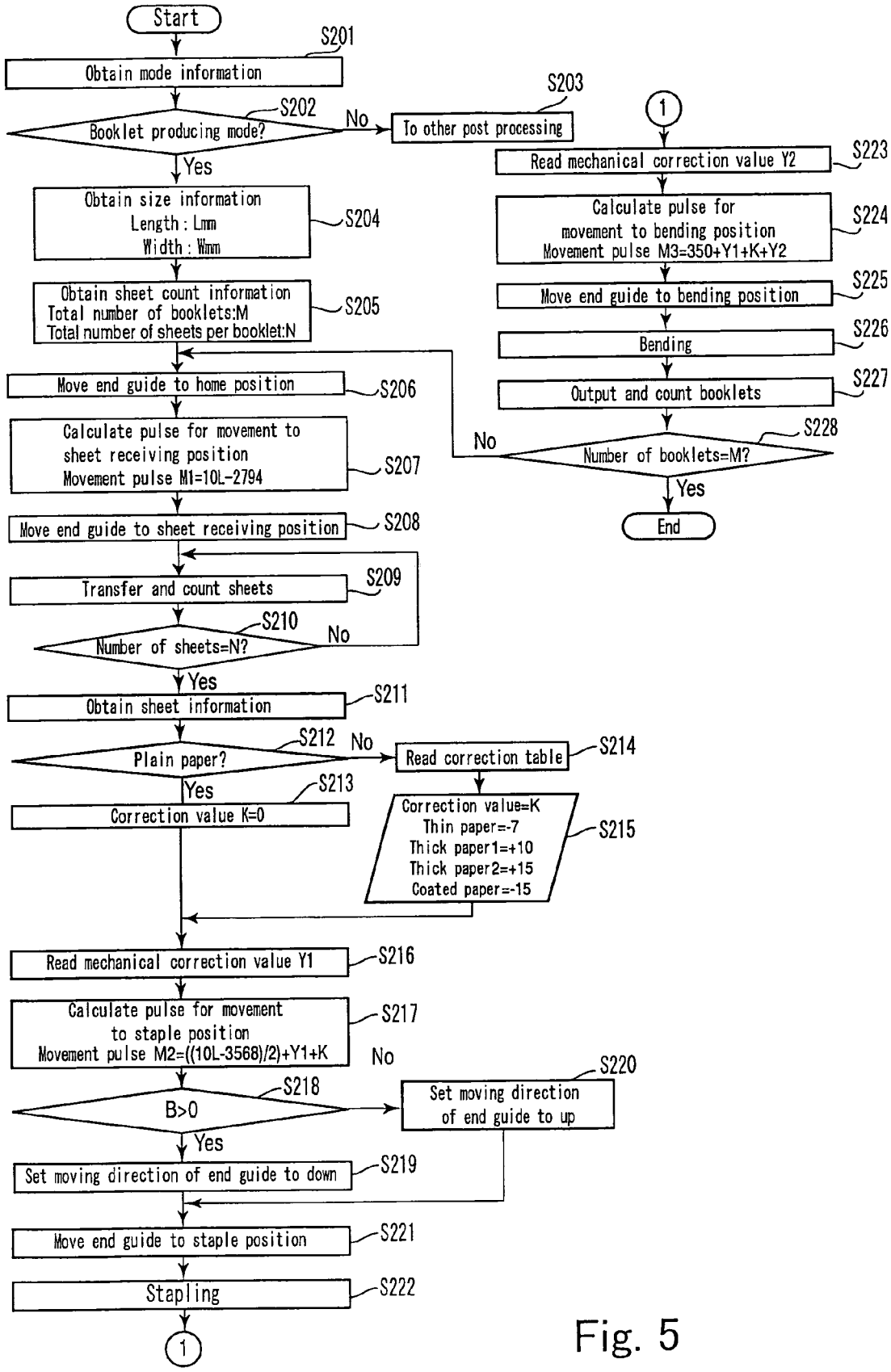
FIG. 5 is a flowchart showing how elements composing the booklet unit are controlled.

FIG. 5 is a flowchart showing how elements composing the booklet unit 14 are controlled.

In the following description, the elements shown in FIGS. 1 through 4 will be referred to without mentioning the figure numbers.

When the flow starts, there is obtained mode information J4 designating the contents of processing, i.e. designating whether or not stapling processing is applied to sheets P, whether or not bending processing is applied to sheets P, or the like (step S201). Subsequently, it is determined whether or not the obtained mode information indicates a booklet producing mode for booklet producing processing in which the center of sheets P is stapled and the sheets P are bent into two (step S202). If it is determined that the obtained mode information does not indicate a booklet producing mode (No at step S202), the contents of the processing designated by the mode information are performed (step S203). In the present embodiment, stapling processing for stapling sheets P and bending processing for bending sheets P into two relate to the present invention. For this reason, booklet producing processing composed of these two kinds of processing will only be described below as an example, which is performed at and after step S204 when it is determined that the obtained mode information indicates a booklet producing mode (Yes at step S202). Therefore, processing other than the booklet producing processing performed at step S203 will not be described.

At step S204, size information J3 indicating the size sheets P as a target of processing is obtained. Further, a length L and a width W are obtained from the size information J3. Next, at step S205, there is obtained sheet count information J2 indicating the number of sheets P to compose a single booklet and the total number of booklets. Further, the total number M of booklets and the total number N of sheets composing a booklet are obtained from the sheet count information J2.

Subsequently, a command to move the end guide 141*a* to the home position Ph is given to the end guide moving system 141*d* and the end guide 141*a* is moved based on the command (step S206). When completion of the movement of the end guide 141*a* is confirmed, a pulse number (hereinafter referred to as "movement pulse") M1 of a step motor in the end guide moving system 141*d* is calculated. The movement pulse M1 is a pulse number required to move the end guide 141*a* from the home position Ph to the sheet receiving position P1 for receiving the sheets P sequentially transferred (step S207). The movement pulse M1 is calculated based on the following equation using the length L obtained at step S204.

$$M1=10\times L-2794 \quad (1)$$

Subsequently, a command to move the end guide 141*a* by the movement pulse M1 is given to the end guide moving system 141*d* and the end guide 141*a* is moved to the sheet receiving position P1 based on the command (step S208).

When completion of the movement of the end guide 141*a* to the sheet receiving position P1 is confirmed, the sheets P are sequentially transferred to the booklet unit 14 and the transferred sheets P are counted one by one (step S209). Then it is determined whether or not the result of the counting has reached the total number N of sheets composing a booklet (step S210). The transferring of sheets P and the counting and the determination of the number of sheets P are continued until the number of the transferred sheets P reaches the total number N of sheets composing a booklet (No at step S210).

When the number of the transferred sheets P reaches the total number N of sheets composing a booklet (Yes at step S210), sheet information J1 indicating the type of the sheets P is obtained (step S211), and it is determined whether or not the type of the sheets P indicated by the sheet information J1 is plain paper (step S212). If it is determined that the type of the sheets P is plain paper (Yes at step S212), a correction value K which will be used in later processing is set to zero (step S213).

On the other hand, if it is determined that the type of the sheets P is not plain paper (No at step S212), a correction table in which five types of sheets are associated with five correction values is read from a predetermined memory (step S214). A value according to the type of the sheets P is searched for through the correction table based on the type indicated by the sheet information J1, and when the value is found, the correction value K is set to the found value (step S215). Specifically, the correction value K is set to "−7" when the sheets P is thin paper, to "10" when first thick paper, to "15" when second thick paper slightly different in thickness from the first thick paper, to "−15" when coated paper.

When sheets P corresponding to the respective values are stored in a standing state in the booklet unit 14, the sheets P are flexed depending on the respective levels of rigidity. As a result, the center of the flexed sheets P is shifted when they are stored in the booklet unit 14. The above values are correction values for correcting the positional shifts of the center of the sheets P.

When the correction value K is set in this way, a predetermined first mechanical correction value Y1 is read out, which is determined based on the structure of the end guide moving system 141*d* (step S216). Then, a movement pulse M2 is calculated based on the following equation using the length L as well as the correction value K and the mechanical correction value Y1 obtained in steps S212 through S216. The movement pulse M2 is a pulse number required to move the end guide 141*a* from the sheet receiving position P1 to a staple position P2 where the center of the sheets P stacked in a standing state is positioned in the staple feeding opening 142*a* of the stapler 142 (step S217).

$$M2=((10\times L-3568/2)+Y1+K \quad (2)$$

When the movement pulse M2 is obtained based on the equation (2), it is determined whether the movement pulse M2 is positive or not (step S218). If the movement pulse M2 is positive (Yes at step S218), the moving direction of the end guide 141*a* is set to a downward direction (step S219). If the movement pulse M2 is negative (No at step S218), the moving direction of the end guide 141*a* is set to an upward direction (step S220). Subsequently, a command to move the end guide 141*a* along the set direction by the movement pulse M2 is given to the end guide moving system 141*d*, and the end guide 141*a* is moved to the staple position P2 based on the command (S221). When completion of the movement of the end guide 141*a* to the staple position P2 is confirmed, a command to perform staple processing is given to the stapler 142 and the stapler 142 staples the center of the sheets P based on the command, thereby forming the set Pg of sheets (step S222).

In the present embodiment, the positional shift of the center of the sheets P is corrected according to the type of the sheets P, and thus the center of the stacked sheets P can be stapled without fail even if the type of the sheets P as a target of processing is any of the above-described five types of sheets.

Subsequently, a second mechanical correction value Y2 different from the first mechanical correction value Y1 is read out (step S223). A movement pulse M3 is calculated based on the following equation using the first and second mechanical correction values Y1 and Y2 and the correction value K. The movement pulse M3 is a pulse number required to move the end guide 141*a* from the staple position P2 to the bending position P3 where the center of the sheets P is positioned in front of the blade 143*a* of the bending system 143 (step S244).

$$M3=350+Y1+K+Y2 \quad (2)$$

Then, a command to move the end guide 141*a* by the movement pulse M3 is given to the end guide moving system 141*d* and the end guide 141*a* is moved to the bending position P3 based on the command (step S225).

When completion of the movement of the end guide 141*a* to the bending position P3 is confirmed, a command to perform bending processing is given to the bending system 143. Based on the command, the bending system 143 causes the blade 143*a* to push the center of the set Pg of sheets and bends the set Pg of sheets, thereby producing a booklet Pb (step S226).

In this way, according to the present embodiment, the correction value K is also used to calculate the movement pulse M3 required to move the end guide 141*a* before the bending processing is applied to the set Pg of sheets. Accordingly, the positional shift of the center of the set Pg of sheets is corrected, and the set Pg of sheets can be bent into two at the center thereof without fail even if the type of the sheets P is any of the above-described five types of sheets.

Subsequently, the booklet Pb is output on the booklet tray 146 by the output rollers 145 and the number of booklets Pb is counted (step S227). Then, it is determined whether the result of the counting has reached the total number M of booklets or not (step S228). If it is determined that the result of the counting has reached the total number M of booklets, (Yes at step S228), the flow ends. On the contrary, if it is determined that the result of the counting has not reached the total number M of booklets, the flow returns to step 206, the end guide 141*a* is moved back to the home position Ph, and steps from S206 through S227 are repeated.

As described above with reference to FIGS. 1 through 5, the booklet unit 14 in the present embodiment can staple and bend the sheets P into two at the center without fail because the correction value K according to the type of sheets P as a target of processing is used to calculate movement pulses that are required to move the end guide 141*a* before the stapling and bending processing are applied thereto. In other words, according to the booklet unit 14 of the present embodiment, a set of any types of sheets P can be stapled and bent into two at a predetermined position thereof such as the center.

As an embodiment of the sheet bending apparatus of the present invention, there has been described a booklet unit for stapling the center of sheets and bending them into two at the center. However, the present invention is not limited to this embodiment and may be, for example, an apparatus for bending sheets one by one into two.

In addition, as an embodiment of each of the sheet bending apparatus and the stapling apparatus of the present invention, there has been described a booklet unit serving as both apparatus, which staples the center of sheets and bends them into two at the center. However, the sheet bending apparatus and the stapling apparatus of the present invention are not limited to this embodiment and may be any apparatus as long as it bends sheets at a desired position and staples the desired position of the sheets.

As described above, according to an embodiment of this invention, a sheet bending apparatus bends a sheet in a standing state, the apparatus including: an information obtaining section that obtains sheet information indicating the type of the sheet; a sheet moving member that includes an abutting section capable of abutting the bottom edge of the sheet in a standing state and of freely moving vertically and vertically moves the sheet by causing the abutting section to move vertically; a sheet bending section that is disposed within a range of movement of the sheet moved by the sheet moving member, has a pushing member extending laterally and intersecting the vertical direction of the sheet, and bends the sheet by causing the pushing member to push a predetermined position of the sheet moved by the sheet moving member, the predetermined position of the sheet being in the vertical direction of the sheet; and controlling section that controls an amount of movement of the abutting section according to the type of the sheet indicated by the sheet information obtained in the information obtaining section so as to allow the abutting section to abut the predetermined position of the sheet.

the information obtaining section obtains sheet information indicating the type of sheets, such as a thin less rigid type and a thick rigid type. The thin less rigid type sheets are easily flexed by the self weight when staked in a standing state whereas the thick rigid type sheets are almost never flexed. Then, in order to cause the abutting section to abut a desired position of the sheet regardless of the rigidity, the controlling section controls an amount of movement of the abutting section moving the sheet, by for example correcting the positional shift caused by the flexure of the sheet, according the type of the sheet indicated by the sheet information. This enables the apparatus to bend any types of sheets including thin sheets and thick sheets into two at a desired position thereof by causing the abutting section to abut that position. In other words, the sheet bending apparatus of the present invention can bend various types of sheets at a predetermined position such as the center thereof.

According to another embodiment of this invention, a stapling apparatus staples stacked sheets in a standing state, the apparatus including: an information obtaining section that obtains sheet information indicating the type of the sheets; a sheet moving member that includes an abutting section capable of abutting the bottom edges of the sheets stacked in a standing state and of freely moving vertically and vertically moves the stacked sheets by causing the abutting section to move vertically; a stapler that is disposed within a range of movement of the stacked sheets moved by the sheet moving member and has a staple feeding opening for feeding a staple by holding the stacked sheets and staples the stacked sheets by causing the staple feeding opening to hold a predetermined position of the sheets moved by the sheet moving member, the predetermined position of the sheets being in the vertical direction of the sheets; and a controlling section that controls an amount of movement of the abutting section according to the type of the sheets indicated by the sheet information obtained in the sheet information obtaining section so as to allow the staple feeding opening to hold the predetermined position of the stacked sheets.

In the stapling apparatus of the present invention, the controlling section controls an amount of the movement of the abutting section moving the sheets by, for example, correcting the positional shift caused by the flexure according to the type of the sheets indicated by the sheet information. This enables the apparatus to hold a desired position of the stacked sheets in the staple feeding opening regardless of type of sheet including thin less rigid types and thick rigid types. In other words, the stapling apparatus of the present invention can staple various types of sheets at a predetermined position such as the center thereof.

The foregoing description of the embodiment of the present invention has been provided for the purposes of illustration and description. It is not intended to be exhaustive or to limit the invention to the precise forms disclosed. Obviously, many modifications and variations will be apparent to practitioners skilled in the art. The embodiment is chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2004-259918 filed on Sep. 7, 2004 including specification, claims, drawings and abstract is incorporated herein by reference in its entirety.

What is claimed is:

1. A sheet bending apparatus which bends a sheet in a standing state, the apparatus comprising:

an information obtaining section that obtains a sheet information indicating the type of the sheet;

a sheet moving member that includes an abutting section capable of abutting the bottom edge of the sheet in a standing state and of freely moving vertically and vertically moves the sheet by causing the abutting section to move vertically;

a sheet bending section that is disposed within a range of movement of the sheet moved by the sheet moving member, has a pushing member extending laterally and intersecting the vertical direction of the sheet, and bends the sheet by causing the pushing member to push a predetermined position of the sheet moved by the sheet moving member, the predetermined position of the sheet being in the vertical direction of the sheet; and a controlling section that controls an amount of movement of the abutting section using a correction value according to the type of the sheet indicated by the sheet information obtained in the information obtaining section so as to allow the abutting section to abut the predetermined position of the sheet, wherein the information obtaining section obtains the sheet information indicating the type of the sheet based on the rigidity of the sheet.

2. The sheet bending apparatus according to claim 1, wherein the sheet moving member moves stacked sheets in a standing state, and the sheet bending section bends the stacked sheets by causing the pushing member to push a predetermined position of the sheets, the predetermined position of the sheets being in the vertical direction of the sheets.

3. The sheet bending apparatus according to claim 1, wherein the controlling section controls movement of the abutting section using a movement pulse calculated using the type of the sheet obtained by the information obtaining section.

4. A stapling apparatus which staples stacked sheets in a standing state, the apparatus comprising:

an information obtaining section that obtains a sheet information indicating the type of the sheets;

a sheet moving member that includes an abutting section capable of abutting the bottom edges of the sheets stacked in a standing state and of freely moving vertically and vertically moves the stacked sheets by causing the abutting section to move vertically;

a stapler that is disposed within a range of movement of the stacked sheets moved by the sheet moving member and has a staple feeding opening for feeding a staple by holding the stacked sheets and staples the stacked sheets by causing the staple feeding opening to hold a predetermined position of the sheets moved by the sheet moving member, the predetermined position of the sheets being in the vertical direction of the sheets; and a controlling section that controls an amount of movement of the abutting section using a correction value according to the type of the sheets indicated by the sheet information obtained in the sheet information obtaining section so as to allow the staple feeding opening to hold the predetermined position of the stacked sheets, wherein the information obtaining section obtains the sheet information indicating the type of the sheets based on the rigidity of the sheets.

* * * * *